US012709508B2

(12) United States Patent
Pietsch et al.

(10) Patent No.: US 12,709,508 B2
(45) Date of Patent: Aug. 18, 2026

(54) DEVICE FOR REPLACING A COIL OR A CORE, ARRANGEMENT, AND METHOD FOR REPLACING A COIL OR A CORE

(71) Applicant: Volkswagen Aktiengesellschaft, Wolfsburg (DE)

(72) Inventors: Tommy Pietsch, Braunschweig (DE); Sebastian Dersch, Braunschweig (DE)

(73) Assignee: PowerCo SE, Salzgitter (DE)

( * ) Notice: Subject to any disclaimer, the term of this patent is extended or adjusted under 35 U.S.C. 154(b) by 130 days.

(21) Appl. No.: 18/766,352

(22) Filed: Jul. 8, 2024

(65) Prior Publication Data

US 2025/0011121 A1 Jan. 9, 2025

(30) Foreign Application Priority Data

Jul. 7, 2023 (DE) ..... 10 2023 206 476.6

(51) Int. Cl.
*B65H 19/30* (2006.01)
*B65H 19/22* (2006.01)

(52) U.S. Cl.
CPC ..... *B65H 19/2207* (2013.01); *B65H 2301/413523* (2013.01); *B65H 2301/4181* (2013.01); *B65H 2408/231* (2013.01); *B65H 2701/511* (2013.01)

(58) Field of Classification Search
CPC ..... B65H 19/12; B65H 19/30; B65H 19/305; B65H 19/2207; B65H 2301/4181
See application file for complete search history.

(56) References Cited

U.S. PATENT DOCUMENTS 3,718,302 A * 2/1973 Mount ..... B65H 19/30 242/533.3
3,845,915 A * 11/1974 Schmidt ..... B29C 53/32 242/596.5
5,031,381 A * 7/1991 Focke ..... B65H 19/123 242/559.2
5,366,174 A 11/1994 Tsukamoto et al.
6,056,232 A * 5/2000 Karaki ..... G03B 27/588 242/559.3
6,276,628 B1 8/2001 Focke et al.
(Continued)

FOREIGN PATENT DOCUMENTS

DE 102013110944 A1 4/2015
DE 102014222166 A1 5/2016
(Continued)

OTHER PUBLICATIONS

Office Action for Japanese Application No. 2024108918 mailed on Jun. 24, 2025.

*Primary Examiner* — Sang K Kim
(74) *Attorney, Agent, or Firm* — Muncy, Geissler, Olds & Lowe, P.C.

(57) ABSTRACT

A device to replace a coil or a core. The coil comprises the sleeve-like core and a film wound thereon. The device is stationary with respect to a winding station at which the film is unwindable from the coil or windable onto the core. The device has at least one stand and a support arm that is movably situated at the stand. The support arm extends along a horizontally running first axis. The coil or the core is situatable so that it is movable on the support arm along the first axis. An arrangement and a method for replacing a coil or a core is also provided.

7 Claims, 13 Drawing Sheets

(56) References Cited

U.S. PATENT DOCUMENTS

| | | | | |
|---|---|---|---|---|
| 7,258,298 | B2 * | 8/2007 | Heikaus | B65H 19/305 242/473.6 |
| 9,573,713 | B2 | 2/2017 | Huber et al. | |
| 10,343,865 | B2 * | 7/2019 | Wimmer | B65H 19/123 |
| 10,577,209 | B2 * | 3/2020 | Wimmer | B65H 19/12 |
| 10,676,303 | B2 * | 6/2020 | Prankl | B65H 19/12 |
| 2010/0002127 | A1 | 1/2010 | Ishii | |
| 2015/0090831 | A1 | 4/2015 | Huber et al. | |
| 2018/0141772 | A1 | 5/2018 | Prankl et al. | |
| 2019/0315587 | A1 * | 10/2019 | Nagafuchi | B65H 19/12 |
| 2019/0337747 | A1 * | 11/2019 | Nagafuchi | B65H 16/04 |
| 2023/0010608 | A1 | 1/2023 | Sale et al. | |

FOREIGN PATENT DOCUMENTS

| | | | |
|---|---|---|---|
| EP | 4119475 | A1 | 1/2023 |
| JP | 201431227 | A | 4/2014 |
| JP | 202154568 | A | 4/2021 |
| JP | 2021134051 | A | 9/2021 |
| WO | WO 03006355 | A1 | 1/2003 |
| WO | WO 2021235623 | A1 | 11/2021 |

* cited by examiner

DEVICE FOR REPLACING A COIL OR A CORE, ARRANGEMENT, AND METHOD FOR REPLACING A COIL OR A CORE

This nonprovisional application claims priority under 35 U.S.C. § 119(a) to German Patent Application No. 10 2023 206 476.6, which was filed in Germany on Jul. 7, 2023, and which is herein incorporated by reference.

BACKGROUND OF THE INVENTION

Field of the Invention

The invention relates to a device for replacing a coil or a core, to an arrangement, in particular comprising the device and a winding station, and to a method for replacing a coil or a core.

Description of the Background Art

The device, the arrangement, and the method are used in particular for unwinding and winding electrode films, in particular coated and/or uncoated electrode films.

Batteries, in particular lithium-ion batteries, are increasingly being used for the drives of motor vehicles. Batteries are generally made up of battery cells, each battery cell having a stack of anode films, cathode films, and separator films optionally present in the form of plies or material layers. At least a portion of the anode films and cathode films are designed as an electrical current collector for discharging the current provided by the battery cell to a consumer situated outside the battery cell. The individual elements of a stack are also referred to below as electrodes or films.

The individual films are provided in particular as continuous material that is optionally coated with an active material, for example, and rewound. The films produced in this way are then supplied as a wound coil to a process for manufacturing battery cells. There, the coils, optionally including coated electrode films, are unwound and, for example, trimmed or separated or disaggregated into individual layers, so that the individual layers can be stacked on top of one another. Uncoated areas of coated films may be used as arresters.

The coils include in particular a so-called winding core (referred to here as a core) onto which the films are wound and from which the films are subsequently unwound.

In light of the ever-continuing automation of production chains in factories for manufacturing (lithium-ion) battery cells, it is absolutely necessary to improve the linkage between the individual machines. Such a production chain includes in particular manufacture of the electrodes (in particular, coating, calendering, slitting, and notching of a carrier material with an active material) and stacking (of the separated layers of films). These processes involve in particular a plurality of splicing operations (i.e., joining processes for connecting electrode films to a continuous material) and cutting operations (for cutting or separating individual layers of electrode films from a continuous material). In particular, these processes or methods are intended to enable a continuous manufacturing operation.

A splice joining method is used in particular during unwinding and winding of a continuous material from/onto a coil. When a first film is completely unrolled from the coil, a new second film of a new coil that is already available in the machine is automatedly attached to the end of the first film. This joining between the first film and the second film is referred to as a splice point or a joining point. Beforehand or afterwards, the end of the first film must be separated from the coil or from the winding core in order to decouple the empty winding core from the process and remove it from the machine. The empty winding core may then be replaced by a new coil.

In particular, after passing through the process, for example the coating of the first film, the continuous material of the first film is rewound onto a (different) winding core. After passing through the splice point in the process (for example, the coating of the film), the first film must be separated from the second film, so that the coil which includes the first film may be removed from the machine. The end of the second film is subsequently reattached to a new or empty winding core so that error-free winding may be ensured.

In industrial processes, the separation of the continuous material, i.e., creation of the separating point, is carried out in particular by blade cutting or circular blade cutting, and is characterized by complex automation technology.

In industrial processes, joining the film material to the winding core is carried out in particular as an adhesive bonding process, and is likewise characterized by complex automation.

No fully automated processes presently exist for handling the coils or the cores. In particular, automated guided vehicles (AGVs) are difficult to use in practice, due to the high precision required during the transfer of the coil or core, in particular when a receiving unit for a core or a coil is supported on only one side (support arm/cantilever).

A method and a device for replacing carrier units having flat packaging material wound onto feed rollers within a packaging machine are known from DE 10 2013 110 944 A1, which corresponds to US 2015/0090831.

A mounting device and a car for mounting and optionally transporting a roll of material is known from WO 03/006355 A1.

A system for replacing a reel of material for manufacturing electrical energy stores and a method therefor are known from EP 4 119 475 A1, which corresponds to US 2023/0010608. The system comprises a self-driving vehicle that is able to travel over a winding station and remove or supply a coil.

SUMMARY OF THE INVENTION

It is therefore an object of the present invention to at least partially solve the problems stated with regard to the prior art. In particular, the aim is to improve the process of handling the coils and/or cores, so that a high degree of automation of the production chain may be ensured.

The features individually set forth herein may be combined with one another, and may be supplemented by the explanatory material from the description and/or details from the figures, which illustrate further examples.

A device for replacing a coil or a core is proposed. The coil comprises the sleeve-like core and a film wound thereon. The device is stationary with respect to a winding station at which the film is unwindable from the coil or windable onto the core. The device has at least one stand and a support arm situated at the stand, the support arm extending along a horizontally running first axis, and the hollow core or the coil being situated or situatable so that it is movable on the support arm along the first axis. The stand together with the support arm is rotatable relative to the winding station, at least about a rotational axis extending along a vertical first direction.

The film described here can be an electrode film for a battery cell.

The battery cell can be a lithium-ion battery cell or some other type of battery cell. A battery cell is a power store that is used, for example, in a motor vehicle for storing electrical energy. In particular, for example a motor vehicle has an electric machine for driving the motor vehicle (a traction drive), the electric machine being drivable by the electrical energy stored in the battery cell.

A battery cell can comprise, for example, a housing encompassing a volume, and situated in the volume at least one electrode film of a first type of electrode (an anode, for example), an electrode film of a second type of electrode (a cathode, for example), and a separator material situated therebetween, as well as an electrolyte, for example a liquid or solid electrolyte.

The individual films can be situated one on top of the other, and in particular form a stack. The electrode films are each associated with a different type of electrode, and are thus designed as an anode or a cathode. Anodes and cathodes are situated in alternation, in each case separated from one another by the separator material.

The film can include a carrier material of an electrode film, and an electrode film or a separator film containing at least one active material, each being used as an integral part of a battery cell. The carrier material includes in particular a metallic material, for example a copper- or aluminum-containing material or alloy.

The sleeve-like core and also the coil (i.e., the core including the film wound thereon) are in particular designed in a known manner and are known per se. The core can have a sleeve-like cavity. The circumferential surface of the core in particular has a cylindrical design. The core extends, starting from a first end, toward a second end, wherein the film is or may be situated on the circumferential surface present between the ends.

By use of the proposed device, in particular a high degree of automation, and at the same time a high level of reproducibility of the method steps to be carried out, are made possible. In particular, the complicated sensor system that is necessary when AGVs are used does not have to be provided, since a stationary arrangement of the device is proposed here.

In the present context, "stationary" can mean, for example, that the position of the device in relation to the winding station is unchangeable. In particular, no AGV is provided whose travel path is freely programmable and specifically is not permanently fixed.

The stand extends in particular essentially along the first direction. The support arm is connected to the stand or (movably) situated at same.

The support arm together with the stand can be rotatable about the rotational axis. It is also possible for the support arm to be rotatable relative to the stand, so that the support arm is then rotatable relative to the stand along a circumferential direction extending about the rotational axis.

The support arm can be displaceable with respect to the stand along the first axis.

The device can additionally include a first displacement unit for displacing the coil or the core, situated on the support arm, along the first axis. The first displacement unit can be situated at the support arm or at the stand.

The coil or the core may be displaced on the support arm via the displacement unit, for example to the extent that the coil or the core may be pushed onto a receiving mandrel of the winding station.

The support arm can extend through the sleeve-like core (optionally of the coil), or may be inserted into this sleeve-like cavity.

The stand can be situated so that it is stationary or movable with respect to the winding station. A unit for moving the stand is an integral part of the device, and the travel path of the stand is unchangeable in relation to the winding station.

The stand can be stationary with respect to the winding station. In the present context, "stationary" can mean that the position of the stand in relation to the winding station is unchangeable. However, rotation of the stand about the rotational axis is possible.

When the stand is situated so that it is movable with respect to the winding station, a unit can be provided. The travel path of the stand made possible by the unit may be unchangeable in relation to the winding station. For example, the unit can include a track system or a similar guide apparatus which itself is stationary with respect to the winding station. The travel path of the stand is in particular possible in only one spatial dimension, i.e., only along the travel path. By use of the unit, a high level of repeatability of the movement of the stand is ensured, which generally cannot be achieved by an AGV.

Furthermore, an arrangement for replacing a coil or a core is proposed, the coil comprising the sleeve-like core and film wound thereon. The arrangement includes at least the described device and the winding station. The winding station has at least one receiving mandrel. The receiving mandrel extends along a horizontally running second axis, the coil or the hollow core being situated or situatable so that it is movable on the receiving mandrel along the second axis. The support arm of the device and the receiving mandrel of the winding station are situatable relative to one another (for example, with mutually aligned axes) in a way that is suitable for a transfer of the coil or the core (from the support arm to the receiving mandrel and/or vice versa).

For the arrangement that is suitable for the transfer, for example a mutually aligned arrangement of the axes, in particular (only) the stand and/or the support arm and/or the unit are/is to be moved with respect to the winding station.

For the transfer of the coil or the core (from the support arm to the receiving mandrel and/or vice versa), the axes are in particular situated relative to one another in such a way that the coil or the core can be moved along the direction of the axes, and thus changed from the support arm onto the receiving mandrel (or vice versa). In particular, it may be provided that for this purpose, the support arm and the receiving mandrel contact one another. In particular, no contact between the support arm and the receiving mandrel is necessary (since the accuracy may be ensured by the stationary arrangement of the stand or by the unit).

The arrangement can additionally include a second displacement unit for displacing the coil or the core on the receiving mandrel along the second axis.

The coil or the core may be displaced on the receiving mandrel via the second displacement unit, in particular to the extent that the coil or the core may be pushed onto a support arm of the device.

In particular, the arrangement can additionally include a first deposition device for the coil or the core, the first deposition device being situated relative to the device in such a way that the support arm is at least retractable into the sleeve-like core or removable therefrom within the scope of a movement that takes place along the first axis.

The deposition device can be used, for example, to receive a coil or a core when it is not situated at the winding station or on the support arm. The deposition device can be used to store or transport the coils or the cores to and from the device or the arrangement.

The deposition device can have a holder via which only the core is contactable, so that the film that is possibly wound up is not contacted by the deposition device. In particular, for example the ends of the sleeve-like core may be supported by the holder. Alternatively, the holder may be designed in the manner of a cantilever arm onto which the core or the coil may be pushed (similarly as for the cantilever arm of the device or the receiving mandrel of the winding station).

The arrangement can additionally include a second deposition device for the coil or the core, the first deposition device being suitably designed to receive at least the core, and the second deposition device being suitably designed to receive at least the coil.

In particular, each deposition device can be suitably designed to receive the core and to receive the coil. The statements concerning the first deposition device also apply in particular for the second deposition device, and vice versa.

Furthermore, a method for replacing a coil or a core by use of the described arrangement is proposed. In a starting state, the coil or the core can be situated on the receiving mandrel of the winding station. The method, beginning at the starting state, may comprise at least the following steps:

a) moving the support arm toward the receiving mandrel so that the axes are suitably situated relative to one another (in alignment, for example) for displacing the coil or the core;
b) displacing the coil or the core along the axes, starting from the receiving mandrel, toward the support arm of the device;
c) moving the support arm toward a first deposition device for the coil or the core;
d) placing the coil or the core on the first deposition device;
e) moving the support arm toward a second deposition device for the core or the coil;
f) situating a new core or coil on the support arm;
g) moving the support arm toward the receiving mandrel so that the axes are suitably situated relative to one another (in alignment, for example) for displacing the core or the coil; and
h) displacing the core or the coil along the axes, starting from the support arm, toward the receiving mandrel;
i) operating the winding station and winding a film onto the core for forming the coil, or unwinding the film from the coil.

The above (non-exhaustive) division of the method steps into a) through i) is intended to be used primarily only for differentiation, and does not dictate an order and/or dependency. In addition, the frequency of the method steps may vary. It is likewise possible for method steps to at least partially overlap one another chronologically. In particular, any of the steps may be carried out as a first step, and the steps following it may be subsequently carried out. In particular, steps a) through i) are carried out in the indicated order.

In particular, before step a) the support arm or the stand (or the device) is in a starting position in which, for example, an interaction (collision or impairment of the freedom of movement, for example) with the winding station or optionally provided deposition device may be ruled out.

Within the scope of step a), a movement of the support arm (beginning from the starting position) toward the receiving mandrel takes place, so that the axes are situated relative to one another (in alignment, for example) in such a way that within the scope of step b) a displacement of the coil of the core can take place. In particular, the movement encompasses only a rotation of the stand about the rotational axis or a movement of the support arm around the stand along a circumferential direction. A movement of the support arm along the first direction may additionally be necessary. A movement of the support arm with respect to the stand along the first axis may additionally be necessary.

Within the scope of step b), a displacement of the coil or the core along the axes, starting from the receiving mandrel, toward the support arm of the device takes place. In particular, this displacement takes place via a second displacement unit (the one described) provided at the winding station. In particular, within the scope of step b) the receiving mandrel pushes the coil or the core downwardly and onto the support arm.

Within the scope of step c), a movement of the support arm toward a first deposition device for the coil or the core takes place. In particular, the movement encompasses only a rotation of the stand about the rotational axis or a movement of the support arm around the stand along a circumferential direction. A movement of the support arm along the first direction may additionally be necessary. A movement of the stand along the fixed travel path via the unit may additionally be necessary.

Within the scope of step d), placement of the coil or the core on the first deposition device takes place. In particular, this placement encompasses only a movement of the support arm along the first direction (i.e., in particular along the stand or the vertical direction). In particular, the support arm is removed from the sleeve-like cavity of the core after the coil or core is placed in the deposition device. The support arm is moved in particular solely along the first axis. This movement takes place in particular relative to the stand or together with the stand via the unit. Alternatively, only a displacement of the coil or the core along the first axis is necessary. The displacement may take place via the first displacement unit, for example.

Within the scope of step e), moving the support arm toward a second deposition device for the core or the coil takes place. In particular, the movement encompasses only a rotation of the stand about the rotational axis or a movement of the support arm around the stand along a circumferential direction. Alternatively or additionally, the movement encompasses (solely) a displacement of the support arm along the first axis, this movement taking place in particular relative to the stand or together with the stand via the unit. A movement of the support arm along the first direction may additionally be necessary. A movement of the stand along the fixed travel path via the unit may additionally be necessary.

Within the scope of step f), situating a new core or coil on the support arm takes place. In particular, this step encompasses (solely) insertion of the support arm into the sleeve-like core along the first axis. A movement of the support arm along the first axis relative to the stand may additionally be necessary.

Within the scope of step g), moving the support arm toward the receiving mandrel takes place, so that the axes are situated relative to one another (in alignment, for example) in such a way that within the scope of step h) a displacement of the core or of the coil can take place. In particular, the movement encompasses only a rotation of the stand about the rotational axis or a movement of the support arm around the stand along a circumferential direction.

Alternatively, the movement additionally encompasses a displacement of the support arm along the first axis, this movement taking place in particular relative to the stand or together with the stand via the unit. A movement of the stand along the fixed travel path via the unit may additionally be necessary Within the scope of step h), a displacement of the core or of the coil along the axes, starting from the support arm, toward the receiving mandrel takes place. In particular, this displacement takes place via a first displacement unit (the one described) provided at the device. In particular, within the scope of step h) the support arm pushes the coil or the core downwardly and onto the receiving mandrel.

Within the scope of step i), operation of the winding station and winding of a film onto the core for forming the coil, or unwinding the film from the coil, takes place.

In particular, at least in step e) only the support arm is moved with respect to the stand along the first axis. Alternatively, at least in step e) at least the stand is moved along a travel path, wherein a unit for moving the stand is an integral part of the device, and the travel path of the stand is unchangeable in relation to the winding station.

The method may be carried out in particular by a system for data processing, for example a control unit, the system having means that are suitably designed, configured, or programmed for carrying out the steps of the method, or that carry out the method. By use of the system, at least an operation of the winding station, an operation of the device, an operation of the arrangement, and/or a provision of the deposition device may take place or be regulated/controlled.

The device or the arrangement can include, for example, the system for data processing.

The system can include, for example, a processor and a memory in which commands to be executed by the processor are stored, as well as data lines or transfer devices that allow transfer of commands, measured values, data, or the like between the stated elements.

Furthermore, a computer program is provided that includes commands which, when the program is executed by a computer, prompt the computer to carry out the described method or the steps of the described method.

Moreover, a computer-readable memory medium is provided that includes commands which, when executed by a computer, prompt the computer to carry out the described method or the steps of the described method.

The statements concerning the device are in particular transferable to the arrangement, the method, the battery cell, the system for data processing, and the computer-implemented method (i.e., the computer or the processor, the computer-readable memory medium), and vice versa.

It is noted that the ordinal numbers used herein ("first," "second," "third," . . . ) are used primarily (only) to distinguish between multiple similar objects, variables, or processes; i.e., in particular no dependency and/or sequence of these objects, variables, or processes relative to one another are/is necessarily specified. If a dependency and/or sequence are/is necessary, this is explicitly indicated herein, or is readily apparent to those skilled in the study of the example specifically described. If a component may be present in a plurality ("at least one"), the description for one of these components may similarly apply for all or a portion of the plurality of these components, although this is not absolutely necessary.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
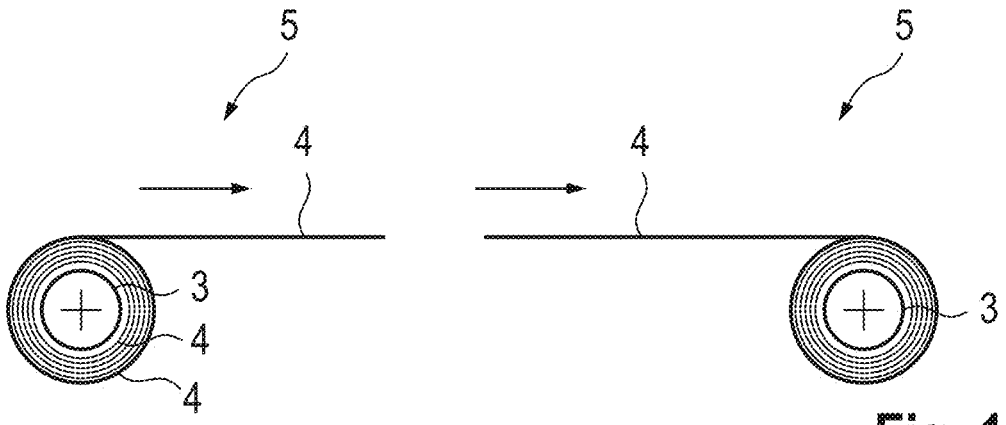
FIG. 1 shows multiple winding stations in a side view.

FIG. 1 shows multiple winding stations 5 in a side view. Each winding station 5 is suitably designed to receive a core 3 or a coil 2. Within the scope of step i) of the method, operation of the winding stations 5 and winding of a film 4 onto the core 3 for forming the coil 2 (right winding station 5), and unwinding the film 4 from the coil 2 (left winding station 5), take place. Processing of the film 4, for example coating or cutting, may take place between the winding stations 5.

Figure 2:
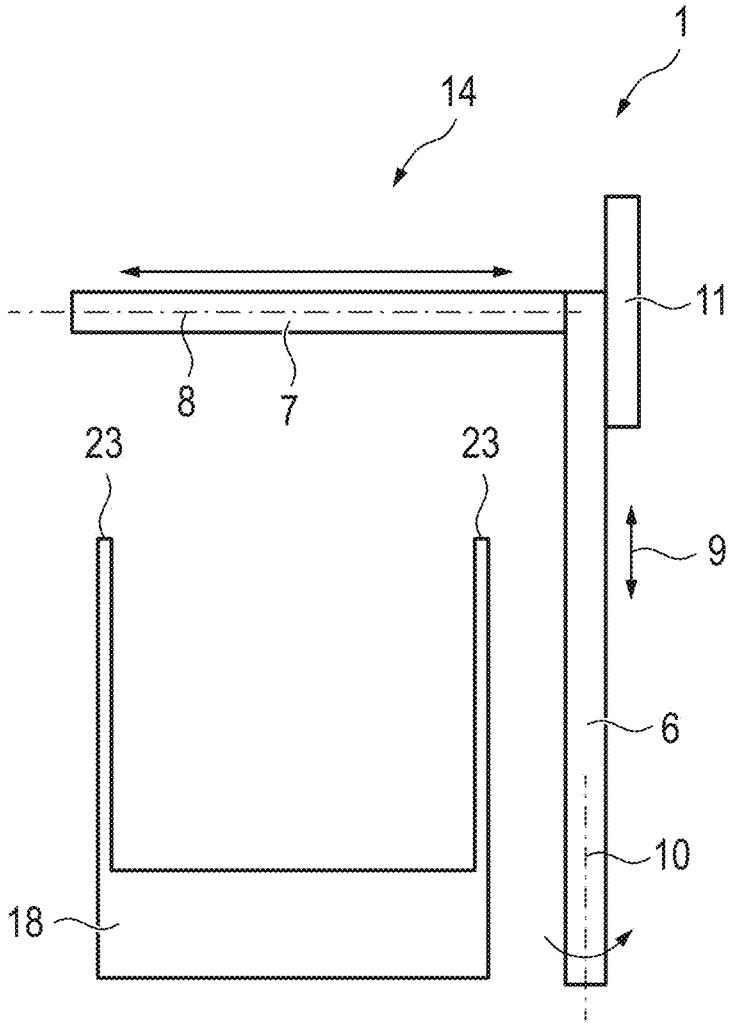
FIG. 2 shows a first example of an arrangement.
Figure 3:
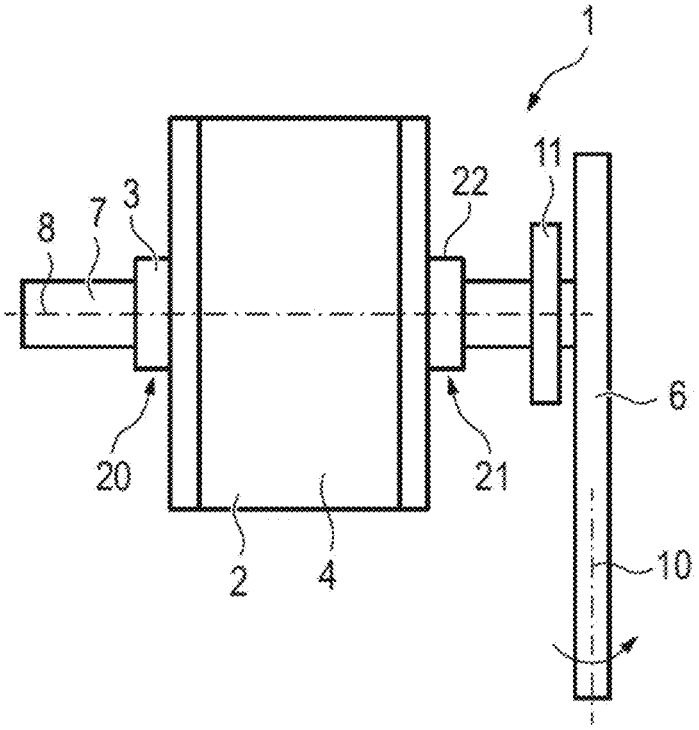
FIG. 3 shows a winding station for the arrangement according to FIG. 2 in a side view.
Figure 4:
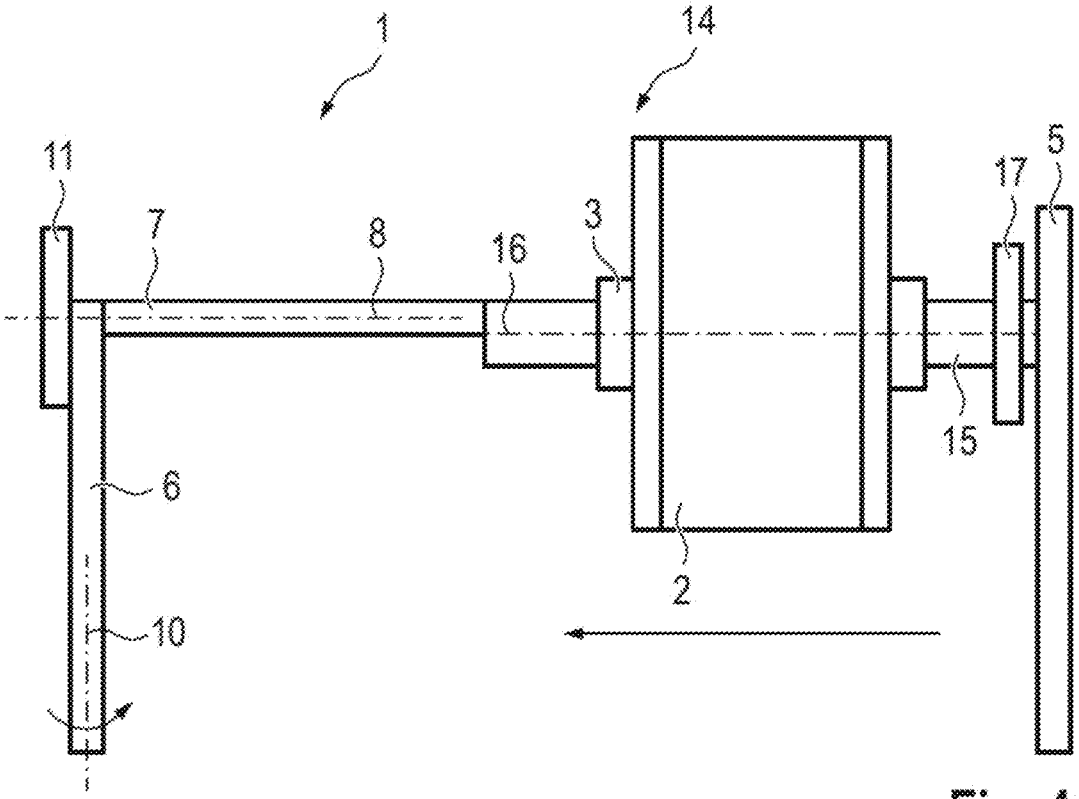
FIG. 4 shows the arrangement according to FIG. 2 according to step b) of the method, in a side view.
Figure 5:
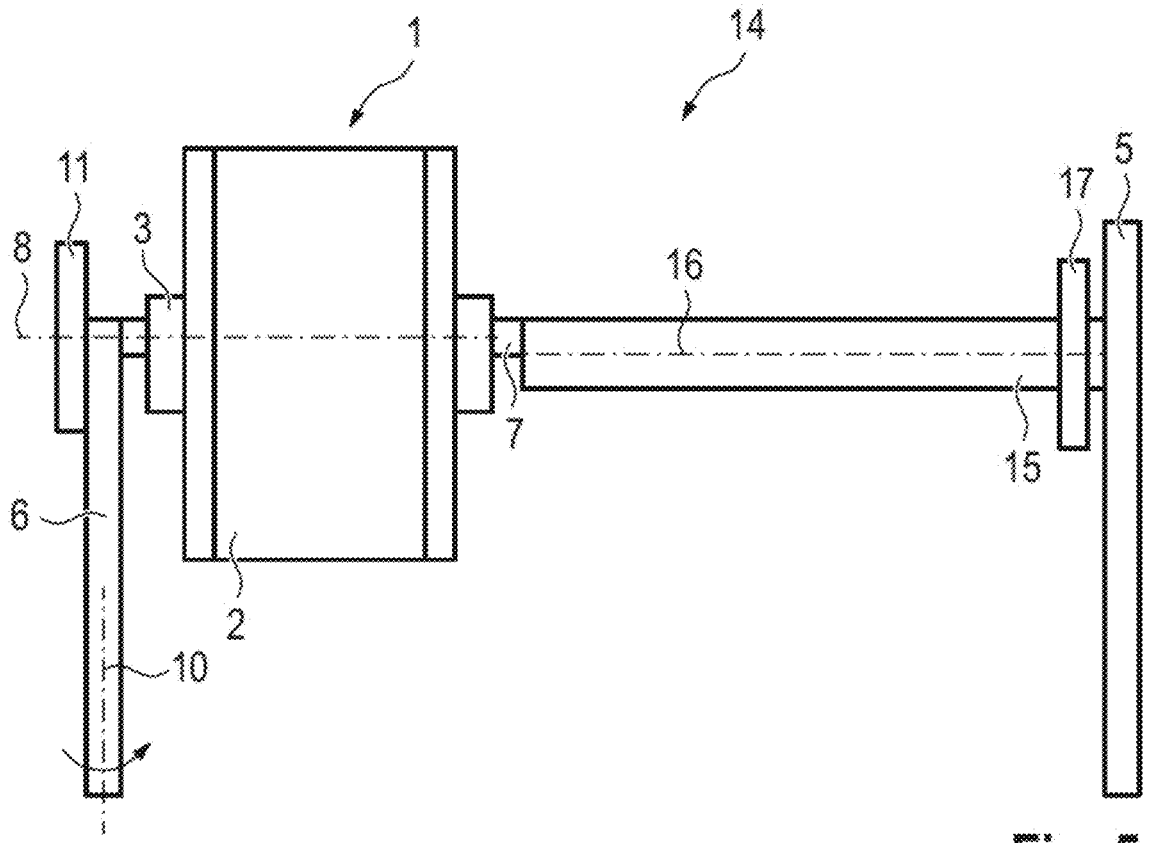
FIG. 5 shows the arrangement according to FIG. 4 according to step c) of the method, in a side view.
Figure 6:
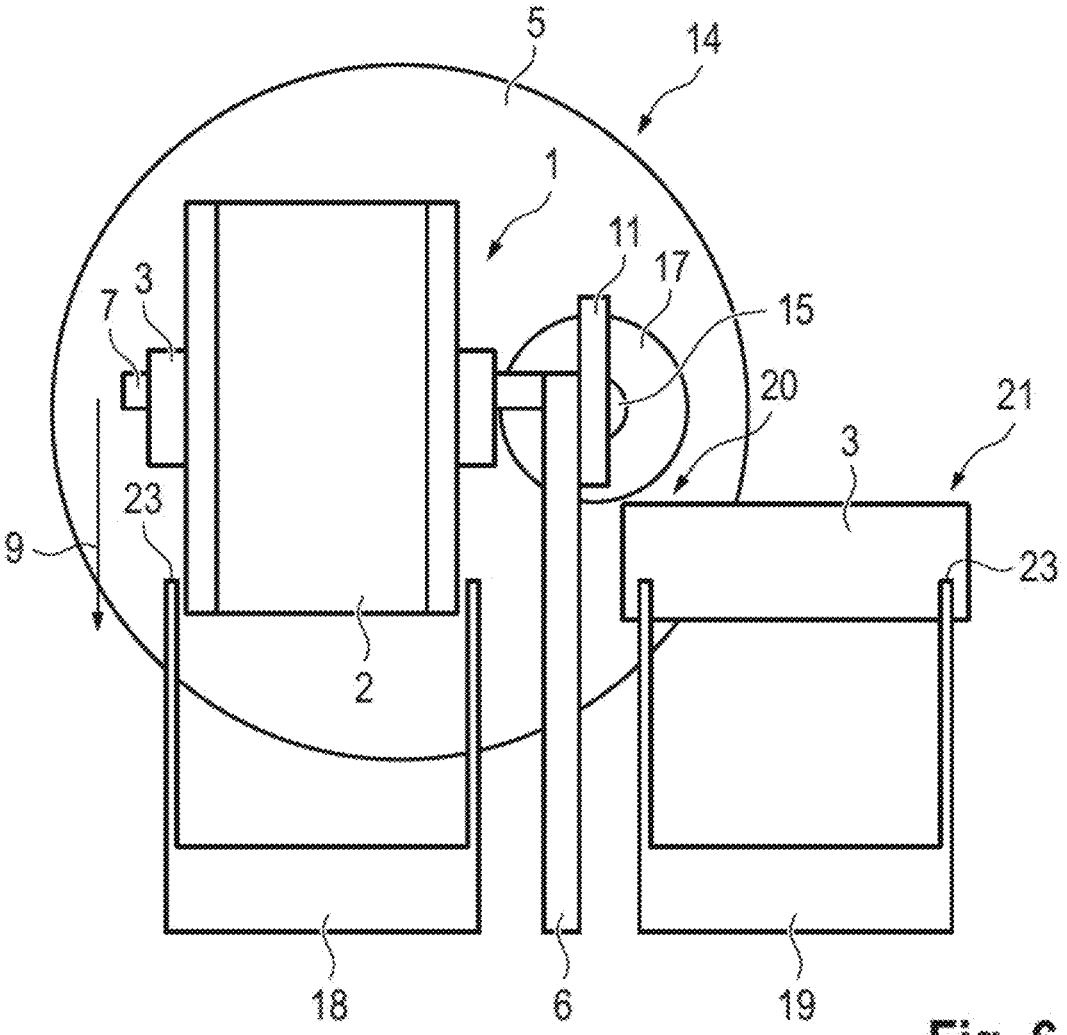
FIG. 6 shows the arrangement according to FIG. 5 according to step d) of the method.
Figure 7:
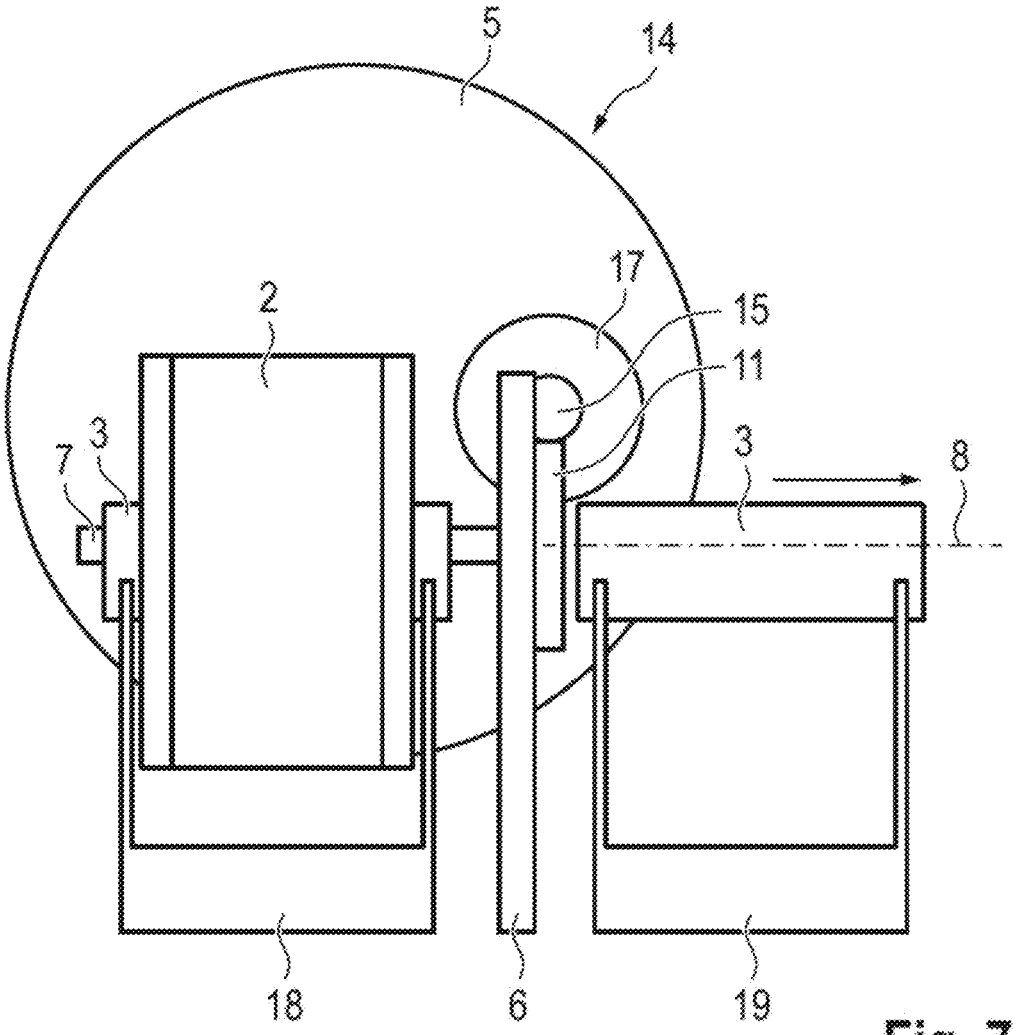
FIG. 7 shows the arrangement according to FIG. 6 according to step e) of the method.
Figure 8:
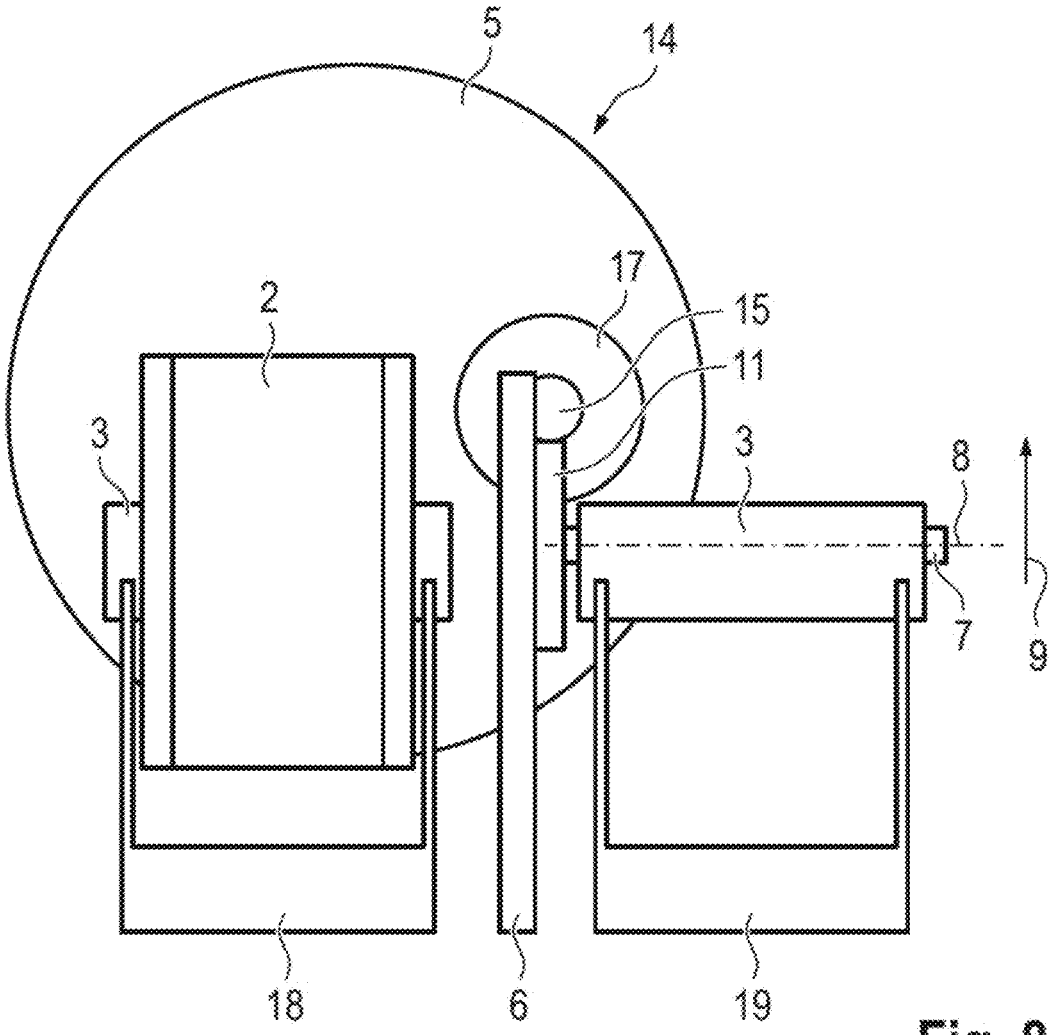
FIG. 8 shows the arrangement according to FIG. 7 directly after step f) of the method.
Figure 9:
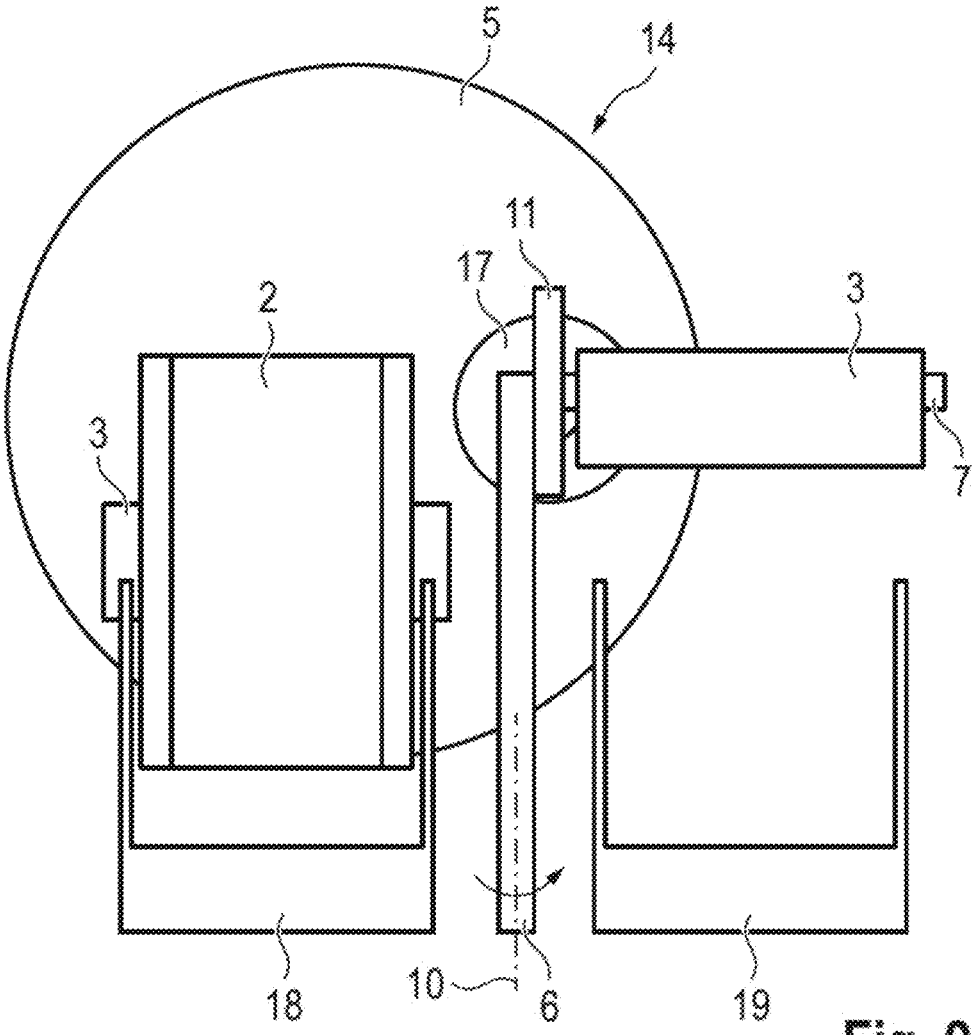
FIG. 9 shows the arrangement according to FIG. 8 during step g) of the method.
Figure 10:
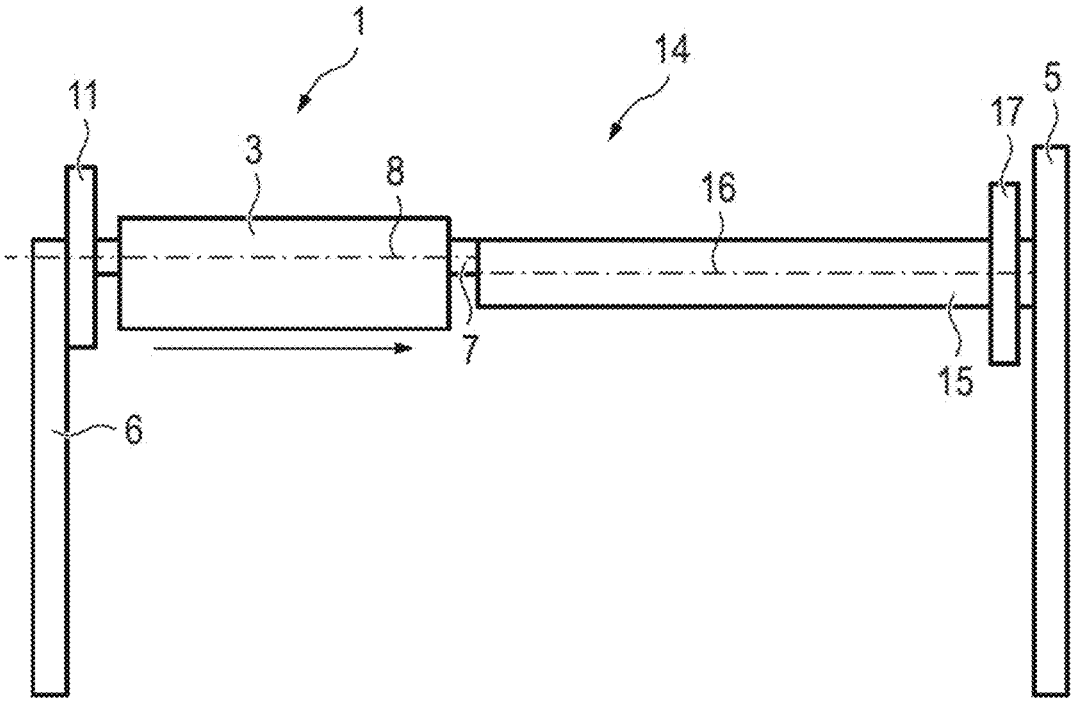
FIG. 10 shows the arrangement according to FIG. 9 according to step h) of the method.
Figure 11:
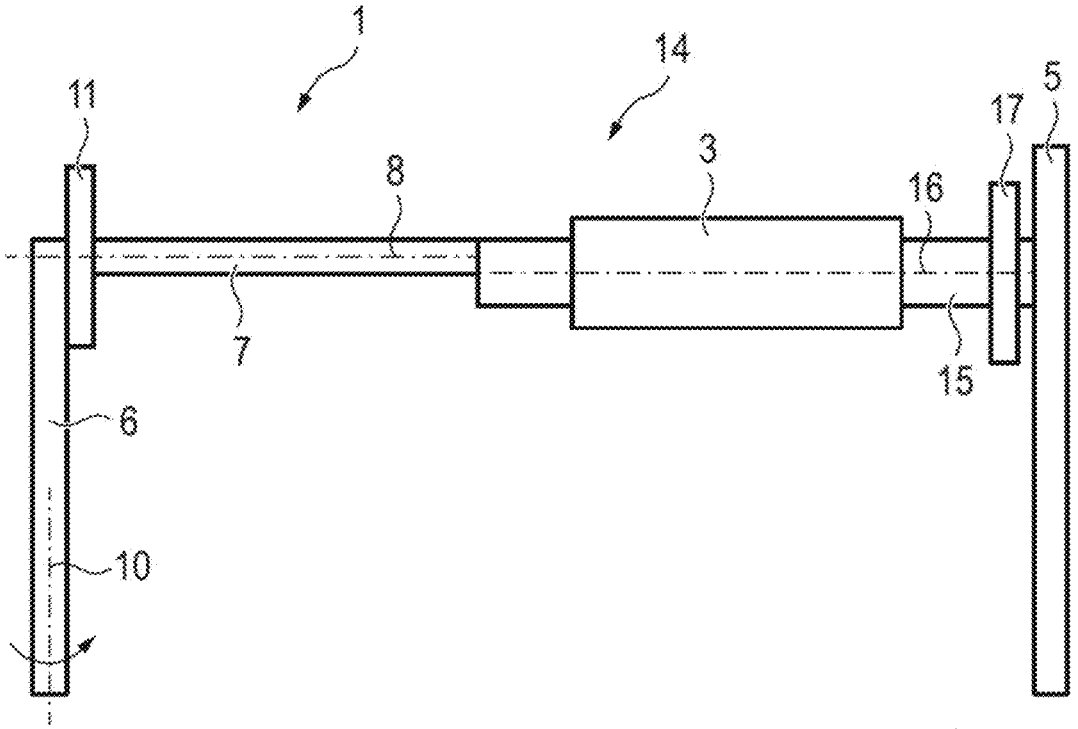
FIG. 11 shows the arrangement according to FIG. 10 directly after step h) of the method.

FIG. 2 shows a first emb example odiment variant of an arrangement 14. FIG. 3 shows a winding station 5 for the arrangement 14 according to FIG. 2, in a side view. FIG. 4 shows the arrangement 14 according to FIG. 2 according to step b) of the method, in a side view. FIG. 5 shows the arrangement 14 according to FIG. 4 according to step c) of the method, in a side view. FIG. 6 shows the arrangement 14 according to FIG. 5 according to step d) of the method. FIG. 7 shows the arrangement 14 according to FIG. 6 according to step e) of the method. FIG. 8 shows the arrangement 14 according to FIG. 7 directly after step f) of the method. FIG. 9 shows the arrangement 14 according to FIG. 8 during step g) of the method. FIG. 10 shows the arrangement 14 according to FIG. 9 according to step h) of the method. FIG. 11 shows the arrangement 14 according to FIG. 10 directly after step h) of the method. FIGS. 2 through 11 are jointly described below. Reference is made to the statements concerning FIG. 1.

The arrangement 14 includes a device 1 and a winding station 5. The device 1 is stationary with respect to a winding station 5 at which the film 4 is unwindable from the coil 2 or windable onto the core 3. The device 1 has a stand 6 and a support arm 7 situated at the stand 6. The support arm 7 extends along a horizontally running first axis 8. The hollow core 3 or the coil 2 is situated or situatable so that it is movable on the support arm 7 along the first axis 8. The stand 6 together with the support arm 7 is rotatable relative to the winding station 5, at least about a rotational axis 10 extending along a vertical first direction 9.

The sleeve-like core 3 and also the coil 2 (i.e., the core 3 including the film 4 wound thereon) are designed in a known manner. The core 3 has a sleeve-like cavity. The circumferential surface of the core 3 has a cylindrical design. The core 3 extends, starting from a first end 20, toward a second end 21, wherein the film 4 is or may be situated on the circumferential surface 22 present between the ends 20, 21.

The winding station 5 has a receiving mandrel 15. The receiving mandrel 15 extends along a horizontally running second axis 16, the coil 2 or the hollow core 3 being situated or situatable so that it is movable on the receiving mandrel 15 along the second axis 16. The support arm 7 of the device 1 and the receiving mandrel 15 of the winding station 5 are suitable for transferring the coil 2 or the core 3 (from the support arm 7 to the receiving mandrel 15 and vice versa), for example situatable with mutually aligned axes 8, 16.

The stand 6 extends essentially along the first direction 9. The support arm 7 is connected to the stand 6 or movably situated on same.

The support arm 7, together with the stand 6 or independently of the stand 6, is rotatable about the rotational axis 10. The support arm 7 is also displaceable with respect to the stand 6 along the first axis 8 and along the first direction 9.

The device 1 additionally includes a first displacement unit 11 for displacing the coil 2 or the core 3, situated on the support arm 7, along the first axis 8. The first displacement unit 11 is situated at the support arm 7.

The coil 2 or the core 3 may be moved on the support arm 7 via the first displacement unit 11, in particular to the extent that the coil 2 or the core 3 may be pushed onto a receiving mandrel 15 of the winding station 5.

The support arm 7 extends through the sleeve-like core 3 (optionally of the coil 2), or may be inserted into this sleeve-like cavity.

The stand 6 is stationary with respect to the winding station 5. In the present context, "stationary" means that the position of the stand 6 in relation to the winding station 5 is unchangeable. However, rotation of the stand 6 about the rotational axis 10 is possible.

Before step a), the support arm 7 or the stand 6 (or the device) is in a starting position (see FIG. 2, for example) in which, for example, an interaction (collision or impairment of the freedom of movement, for example) with the winding station 5 or a provided deposition device 18, 19 may be ruled out.

Within the scope of step a), a movement of the support arm 7 (beginning from the starting position) toward the receiving mandrel 15 takes place, so that the axes 8, 16 are situated relative to one another (in alignment, for example) in such a way that the coil 2 is displaceable toward the support arm 7 (see FIG. 4). The movement encompasses only a rotation of the stand 6 or of the support arm 7 about the rotational axis 10.

Within the scope of step b), a displacement of the coil 2 along the axes 8, 16, starting from the receiving mandrel 15, toward the support arm 7 of the device 1 takes place (see FIG. 4). This displacement takes place via a second displacement unit 17 provided at the winding station 5. Within the scope of step b), the receiving mandrel 15 pushes the coil 2 downwardly and onto the support arm 7 (see FIG. 5).

Within the scope of step c), a movement of the support arm 7 toward a first deposition device 18 for the coil takes place. This movement encompasses only a rotation of the stand 6 or of the support arm 7 about the rotational axis 10 (see FIG. 6).

Within the scope of step d), placement of the coil 2 on the first deposition device 18 takes place. This placement encompasses only a movement of the support arm 7 along the first direction 9 (see FIG. 6).

The deposition device 18 has a holder 23 via which only the core 3 is contactable, so that the wound film 4 is not contacted by the deposition device 18. The ends 20, 21 of the sleeve-like core 3 are supported by the holder 23.

The support arm 7 is removed from the sleeve-like cavity of the core 3 after the coil 2 is placed in the first deposition device 18. The support arm 7 is moved, with respect to the stand 6, solely along the first axis 8 (see FIG. 7).

Within the scope of step e), moving the support arm 7 toward a second deposition device 19 for a core 3 takes place. This movement encompasses only a displacement of the support arm 7 along the first axis 8, this movement taking place relative to the stand 6 (see FIG. 8).

Within the scope of step f), situating the (new) core 3 on the support arm 7 takes place. This step encompasses solely insertion of the support arm 7 into the sleeve-like core 3 along the first axis 8. For this purpose, the deposition devices 18, 19 are situated in such a way that the cores 3 placed on the deposition devices 18, 19 are situated coaxially with respect to one another.

Within the scope of step g), moving the support arm 7 toward the receiving mandrel 15 takes place, so that the axes 8, 16 are situated relative to one another (in alignment, for example) in such a way that the core 3 is displaceable toward the receiving mandrel 15. This movement encompasses a rotation of the stand 6 or of the support arm 7 about the rotational axis 10. In addition, a movement of the support arm 7 along the first direction 9 is necessary in order to remove the core 3 from the second deposition device 19 (see FIGS. 9 and 10).

Within the scope of step h), a displacement of the core 3 along the coaxially situated axes 8, 16, starting from the support arm 7, toward the receiving mandrel 15 takes place. This displacement takes place via a first displacement unit 11 provided at the device 1. Within the scope of step h), the support arm 7 pushes the core 3 downwardly and onto the receiving mandrel 15 (see FIG. 11).

Within the scope of step i), operation of the winding station 5 and winding of a film 4 onto the core 3 for forming the coil 2, or unwinding the film 4 from the coil 2, takes place (see FIG. 1).

Figure 12:
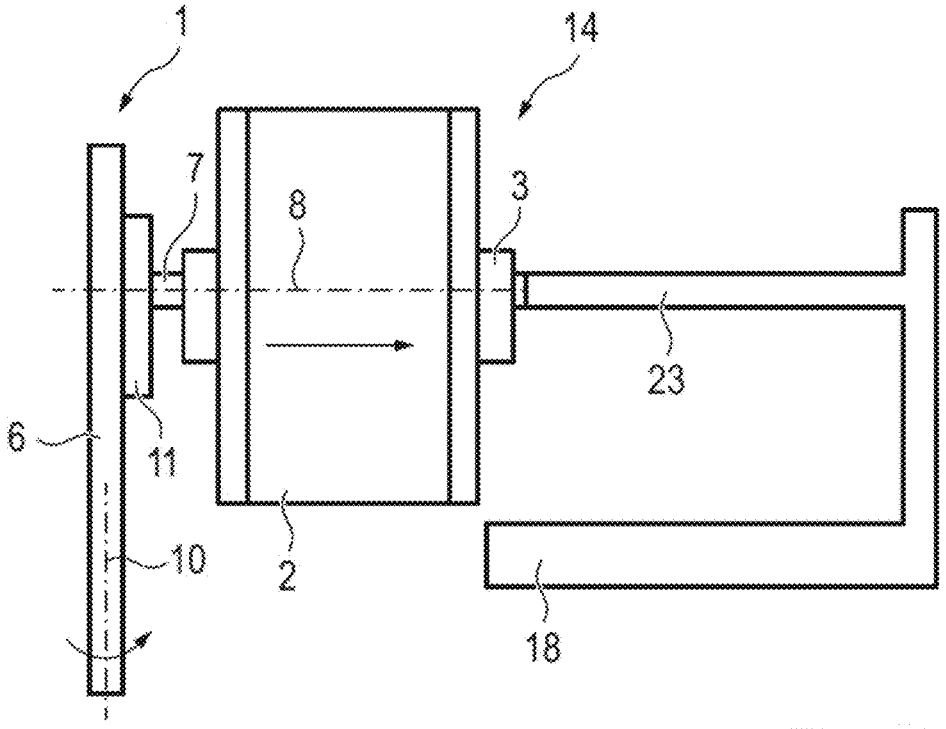
FIG. 12 shows a second example of an arrangement and step d) of the method.

FIG. 12 shows a second example variant of an arrangement 14 and step d) of the method. Within the scope of step d), placement of the coil 2 on the first deposition device 18 takes place. Here, the deposition device 18 is designed in such a way that a coil 2 (or a core 3) can be transferred from the support arm 7 toward the deposition device 18 only by moving along the first axis. For this purpose, the holder 23 of the deposition device 18 is designed in the manner of a cantilever arm onto which the coil 2 may be pushed (similarly as for the support arm 7 of the device 1 or the receiving mandrel 15 of the winding station 5). This placement involves only a rotation of the support arm 7 about the rotational axis 10, so that after the rotation the first axis 8 is situated (essentially) coaxially with respect to the holder 23 of the deposition device 18.

Figure 13:
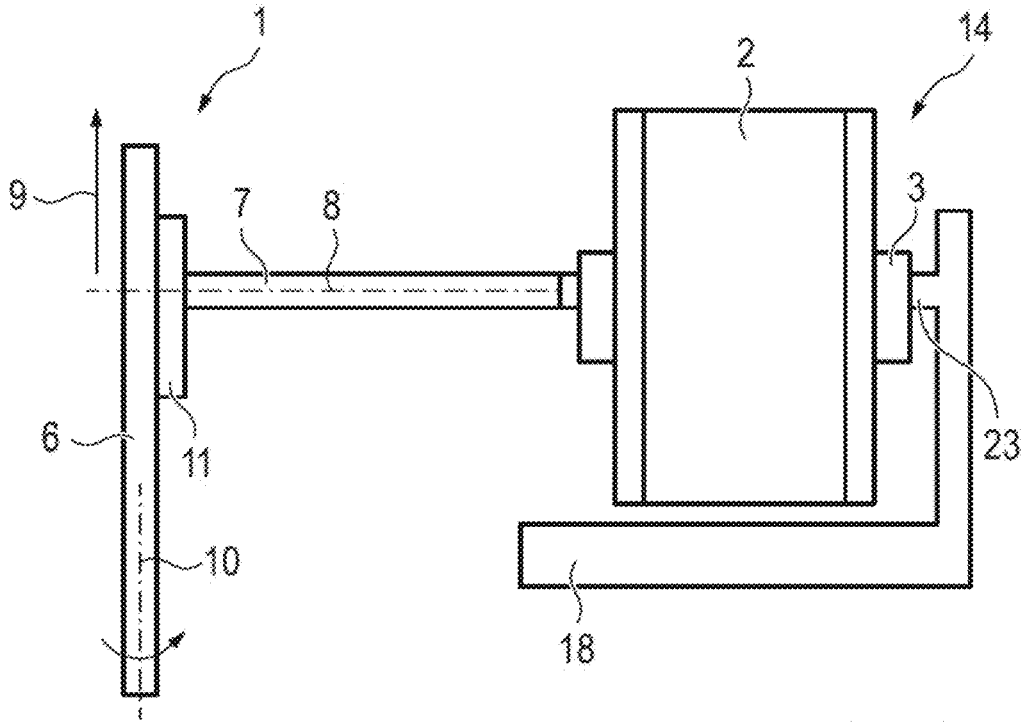
FIG. 13 shows the arrangement according to FIG. 12 and step e) of the method.

FIG. 13 shows the arrangement 14 according to FIG. 12 and step e) of the method. Within the scope of step e), moving the support arm 7 toward a second deposition device 19 for the core 3 takes place. After the coil 3 is placed (not absolutely necessary), the support arm 7 is moved along the first direction 9 relative to the stand 6, and the stand 6 rotates about the rotational axis 10 toward the second deposition device 19.

Figure 14:
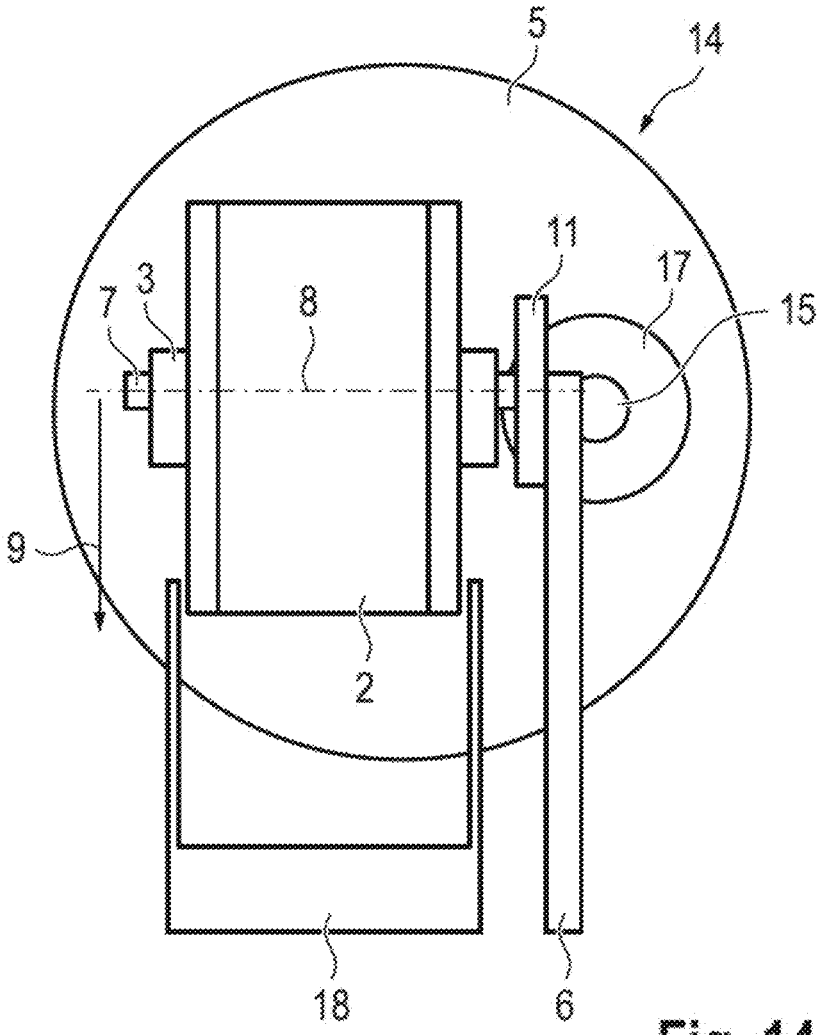
FIG. 14 shows a third example variant of an arrangement and step c) of the method.
Figure 15:
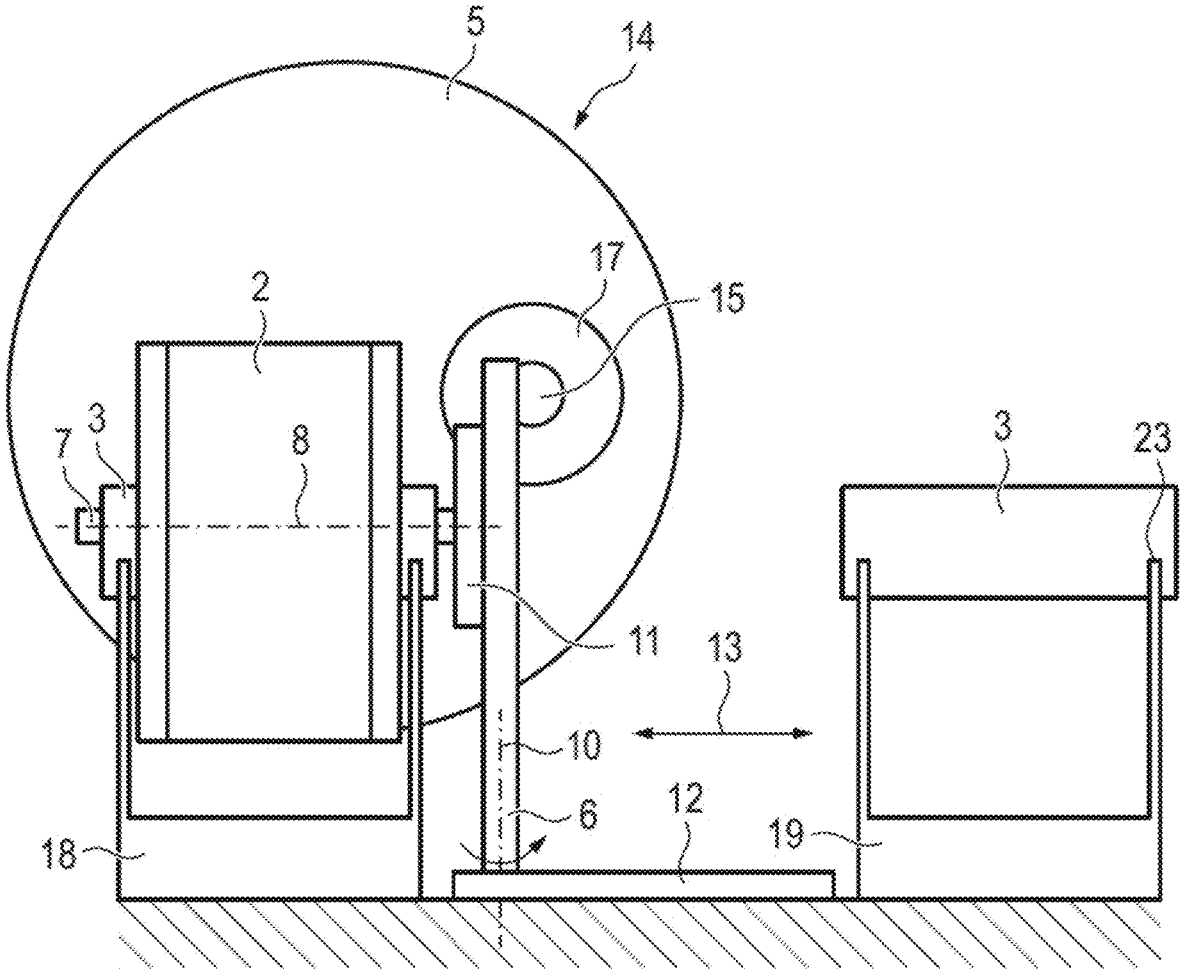
FIG. 15 shows the arrangement according to FIG. 14 and step e) of the method.
Figure 16:
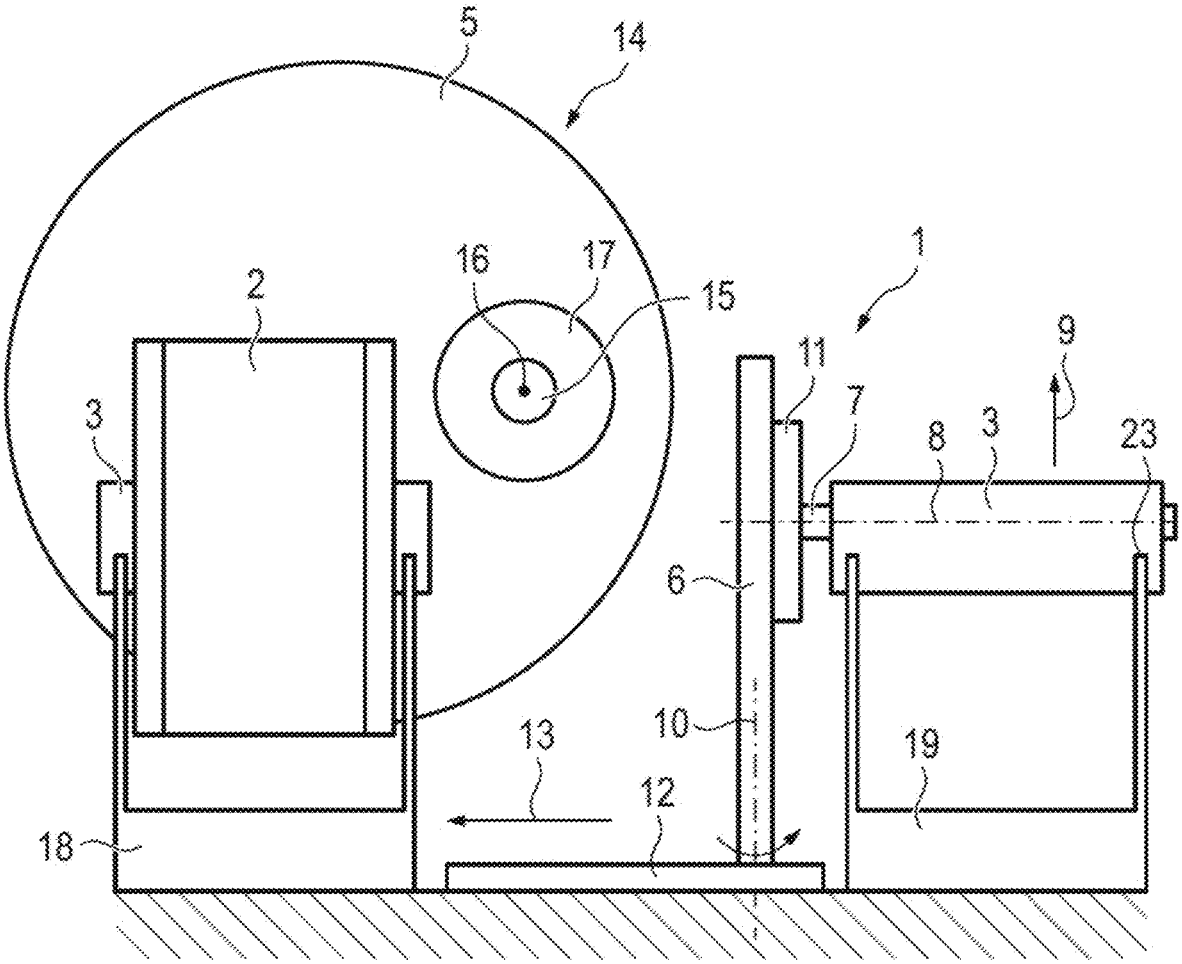
FIG. 16 shows the arrangement according to FIG. 15 and step g) of the method.
Figure 17:
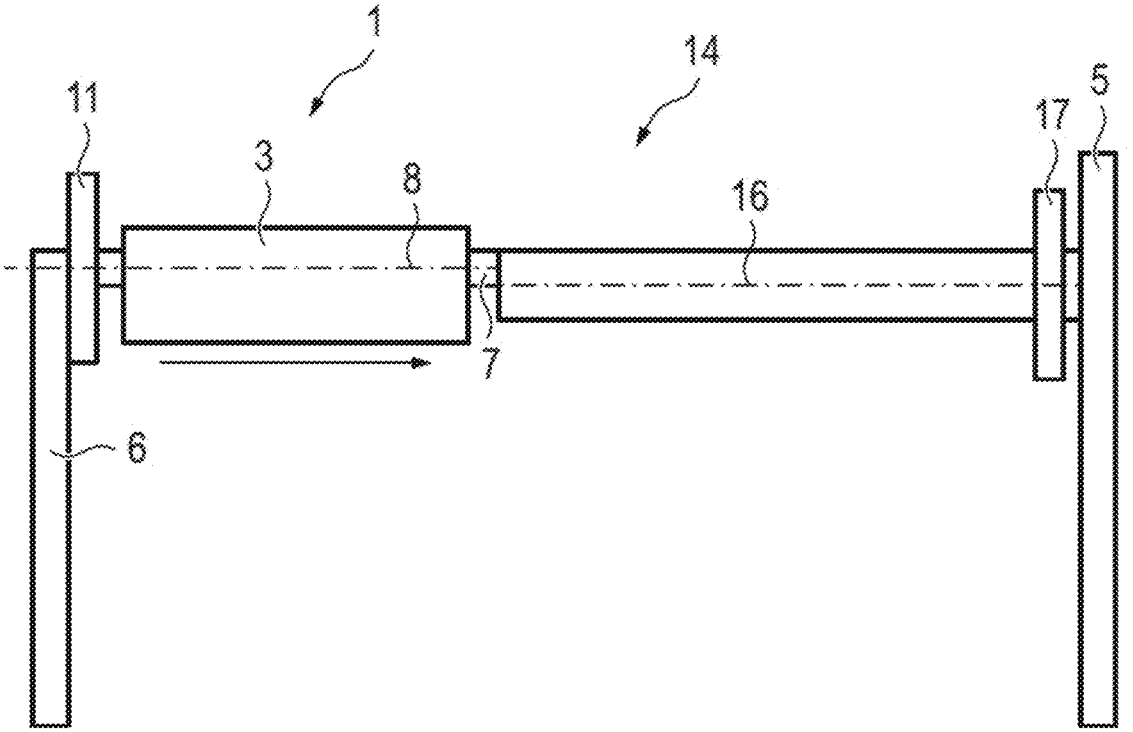
FIG. 17 shows the arrangement according to FIG. 16 and step h) of the method.

FIG. 14 shows a third example variant of an arrangement 14 and step c) of the method. FIG. 15 shows the arrangement 14 according to FIG. 14 and step e) of the method. FIG. 16 shows the arrangement 14 according to FIG. 15 and step g) of the method. FIG. 17 shows the arrangement 14 according to FIG. 16 and step h) of the method. FIGS. 14 through 17 are jointly described below. Reference is made to the statements concerning FIGS. 1 through 13.

Within the scope of step c), moving the support arm 7 toward the first deposition device 18 for the coil 2 takes place. This movement encompasses a rotation of the stand 6 or of the support arm 7 about the rotational axis 10. In addition, a movement of the support arm 7 along the first direction 9 is necessary (see FIG. 14).

Within the scope of step d), placement of the coil 2 on the first deposition device 18 takes place. This placement requires only a movement of the support arm 7 along the first direction 9 (see FIG. 14).

After the coil 2 is placed in the deposition device 18, the support arm 7 is removed from the sleeve-like cavity of the core 3. This movement together with the stand 6 takes place via the unit 12 (see FIG. 15). In the process, the support arm 7 is optionally moved along the first axis 8.

Within the scope of step e), moving the support arm 7 toward a second deposition device 19 for the core 3 takes place. The movement optionally encompasses a rotation of the stand 6 about the rotational axis 10, and a movement together with the stand 6 via the unit 12 along the fixed travel path 13 (see FIG. 15).

Within the scope of step f), situating a new core 3 on the support arm 7 takes place. This step involves solely insertion of the support arm 7 into the sleeve-like core 3 along the first axis 8. This movement, optionally together with the stand 6, takes place via the unit 12 (see FIGS. 15 and 16).

Within the scope of step g), moving the support arm 7 toward the receiving mandrel 15 takes place, so that the axes 8, 16 are situated relative to one another (in alignment, for example) in such a way that within the scope of step h) the displacement can take place. The movement encompasses a rotation of the stand 6 about the rotational axis 10, and a movement together with the stand 6 via the unit 12 along the fixed travel path 13 (see FIG. 16).

Within the scope of step h), a displacement of the core 3 along the axes 8, 16, starting from the support arm 7, toward the receiving mandrel 15 takes place. This displacement takes place via a first displacement unit 11 provided at the device 1. Within the scope of step h), the support arm 7 receiving mandrel 15 pushes the core 3 downwardly and onto the receiving mandrel 15.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device to replace a coil or a core, the coil comprising the core and a film wound thereon, the device being arranged adjacent to a winding station at which the film is unwindable from the core or windable onto the core, the device comprising:

at least one stand; and a support arm arranged at the stand, the support arm extending along a horizontally running first axis, the coil or the core being arranged so as to be movable on the support arm along the first axis, wherein the stand together with the support arm is rotatable relative to the winding station, at least about a rotational axis extending along a vertical first direction, and wherein the support arm is displaceable with respect to the stand along the first axis.

2. The device according to claim 1, further comprising a first displacement unit for displacing the coil or the core arranged on the support arm along the first axis.

3. The device according to claim 1, wherein the stand is arranged so as to be movable with respect to the winding station, a unit for moving the stand being an integral part of the device, and a travel path of the stand being unchangeable in relation to the winding station.

4. An arrangement to replace a coil or a core, wherein the coil comprises the core and a film wound thereon, the arrangement comprising:

at least one device according to claim 1; and the winding station that has at least one receiving mandrel, the receiving mandrel extending along a horizontally running second axis, and the coil or the core being arranged so as to be movable on the receiving mandrel along the second axis, and the support arm of the device and the receiving mandrel are arranged relative to one another for a transfer of the coil or the core.

5. The arrangement according to claim 4, further comprising a first deposition device for the coil or the core, the first deposition device being arranged relative to the device and having a holder on which ends of the core are placed when the core or coil is mounted on the first deposition device so that the core or coil is oriented horizontally on the first deposition device, wherein the support arm is at least retractable into the core or removable therefrom within a movement that takes place along the first axis while the core or coil is mounted on the first deposition device.

6. An arrangement to replace a coil or a core, wherein the coil comprises the core and a film wound thereon, the arrangement comprising:

at least one device to replace a coil or a core, the coil comprising the core and a film wound thereon, the device being arranged adjacent to a winding station at which the film is unwindable from the core or windable onto the core, and the device comprising: at least one stand; and a support arm arranged at the stand, the support arm extending along a horizontally running first axis, the coil or the core being arranged so as to be movable on the support arm along the first axis, wherein the stand together with the support arm is rotatable relative to the winding station, at least about a rotational axis extending along a vertical first direction;

the winding station that has at least one receiving mandrel, the receiving mandrel extending along a horizontally running second axis, and the coil or the core being arranged so as to be movable on the receiving mandrel along the second axis, and the support arm of the device and the receiving mandrel are arranged relative to one another for a transfer of the coil or the core, wherein the arrangement further comprises a first displacement unit for displacing the coil or the core arranged on the support arm along the first axis and a second displacement unit to displace the coil or the core arranged on the receiving mandrel along the second axis, such that the coil or the core is displaced along the receiving mandrel, or, wherein the stand is arranged so as to be movable with respect to the winding station, a unit for moving the stand being an integral part of the device, and a travel path of the stand being unchangeable in relation to the winding station.

7. An arrangement to replace a coil or a core, wherein the coil comprises the core and a film wound thereon, the arrangement comprising:

at least one device to replace a coil or a core, the coil comprising the core and a film wound thereon, the device being arranged adjacent to a winding station at which the film is unwindable from the core or windable onto the core, and the device comprising: at least one stand; and a support arm arranged at the stand, the support arm extending along a horizontally running first axis, the coil or the core being arranged so as to be movable on the support arm along the first axis, wherein the stand together with the support arm is rotatable relative to the winding station, at least about a rotational axis extending along a vertical first direction;

the winding station that has at least one receiving mandrel, the receiving mandrel extending along a horizontally running second axis, and the coil or the core being arranged so as to be movable on the receiving mandrel along the second axis, and the support arm of the device and the receiving mandrel are arranged relative to one another for a transfer of the coil or the core;

a first deposition device for the coil or the core, the first deposition device being arranged relative to the device such that the support arm is at least retractable into the core or removable therefrom within a movement that takes place along the first axis; and a second deposition device for the coil or the core, the first deposition device being provided to receive at least the core, and the second deposition device being provided to receive at least the coil.

* * * * *